US010254697B2

(12) United States Patent
Ohshika

(10) Patent No.: US 10,254,697 B2
(45) Date of Patent: Apr. 9, 2019

(54) IMAGE FORMING APPARATUS

(71) Applicant: Oki Data Corporation, Tokyo (JP)

(72) Inventor: Hirotaka Ohshika, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/957,436

(22) Filed: Apr. 19, 2018

(65) Prior Publication Data

US 2018/0307175 A1 Oct. 25, 2018

(30) Foreign Application Priority Data

Apr. 21, 2017 (JP) ..... 2017-084227

(51) Int. Cl.
*G03G 15/00* (2006.01)
*G03G 21/16* (2006.01)

(52) U.S. Cl.
CPC ..... *G03G 15/6523* (2013.01); *G03G 15/5016* (2013.01); *G03G 21/1628* (2013.01); *G03G 2221/1663* (2013.01)

(58) Field of Classification Search
None
See application file for complete search history.

(56) References Cited

U.S. PATENT DOCUMENTS 8,449,105 B2 * 5/2013 Kanazawa ..... B41J 3/60 347/104
2017/0255130 A1 * 9/2017 Ui ..... G03G 15/0894

FOREIGN PATENT DOCUMENTS

JP 2016-044026 A 4/2016

* cited by examiner

*Primary Examiner* — Victor Verbitsky
(74) *Attorney, Agent, or Firm* — Muncy, Geissler, Olds & Lowe, P.C.

(57) ABSTRACT

An image forming apparatus includes a medium carrying part carrying a continuous medium, an image forming part performing a print process, a cutting part cutting the medium, replacement parts that are expendable and expected to be replaced when reaching its end of life, a usage detection part detecting usages of all of the replacement parts, a controller controlling these parts. The controller determines if one of the replacement parts reaches its end of life during the print process based on the detection result of the usage detection part wherein the one of the replacement parts is defined as a life-end part, and when the life-end part is found, the controller determines whether or not to cut the medium according to a type of the life-end part and selection information input by an operator before the print process starts.

10 Claims, 6 Drawing Sheets

IMAGE FORMING APPARATUS

TECHNOLOGY FIELD

The present invention relates to an image forming apparatus that forms an image on a continuous medium.

BACKGROUND

A conventional image forming apparatus performs printing by continuously forming an image on a continuous medium wound in a roll-like shape (for example, see Patent Document 1).

RELATED ART

[Patent Doc.1] JP Laid-Open Patent Publication 2016-44026

However, in the conventional technology, in a case where an expendable item of the image forming apparatus reaches its end of life, when the expendable item is replaced, in a case where the print medium is not cut, it is necessary to remove the print medium remaining inside the image forming apparatus, and the removed print medium becomes waste medium (waste sheet); and, in a case where the print medium is cut in order to avoid occurrence of a waste sheet, the roll-shaped medium is divided into two rolls. Thus, there is a problem that it is possible that a user-desired result is not obtained and user convenience is lowered. The present invention is intended to solve such a problem and to improve user convenience when an expendable item reaches its end of life.

SUMMARY

An image forming apparatus disclosed in the application includes a medium carrying part that carries a continuous medium; an image forming part that performs a print process forming a developer image on the medium; a cutting part that cuts the medium; a plurality of replacement parts that are expendable and expected to be replaced when reaching its end of life; a usage detection part that detects usages of all of the replacement parts, providing a detection result; a controller that controls the medium carrying part, the image forming part, the cutting part and the usage detection part. Wherein the controller determines if one of the replacement parts reaches its end of life during the print process based on the detection result of the usage detection part wherein the one of the replacement parts is defined as a life-end part, and when the life-end part is found, the controller determines whether or not to cut the medium according to a type of the life-end part and selection information input by an operator before the print process starts.

An image forming apparatus includes a medium carrying part that carries a continuous medium, an image forming part that performs a print process forming a developer image on the medium, a cutting part that cuts the medium, a cover that is able to be open and closed, a plurality of replacement parts that are expendable and to be replaced while the cover is open, a condition detection part that detects conditions of all of the replacement parts, providing a detection result, a controller that controls the medium carrying part, the image forming part, the cutting part and the condition detection part. When the controller stops printing to replace one of the replacement parts, which is regarded as a replacement target, during the print process, the controller cuts the medium in a case where the medium is positioned closer to the cover than the one of the replacement parts that is the replacement target.

The present invention so accomplished achieves an effect allowing user convenience to be improved when an expendable item reaches its end of life.

DETAILED DESCRIPTIONS OF THE PREFERRED EMBODIMENTS

In the following, an embodiment of an image forming apparatus of the present invention is described with reference to the drawings.

EMBODIMENT

Figure 1:
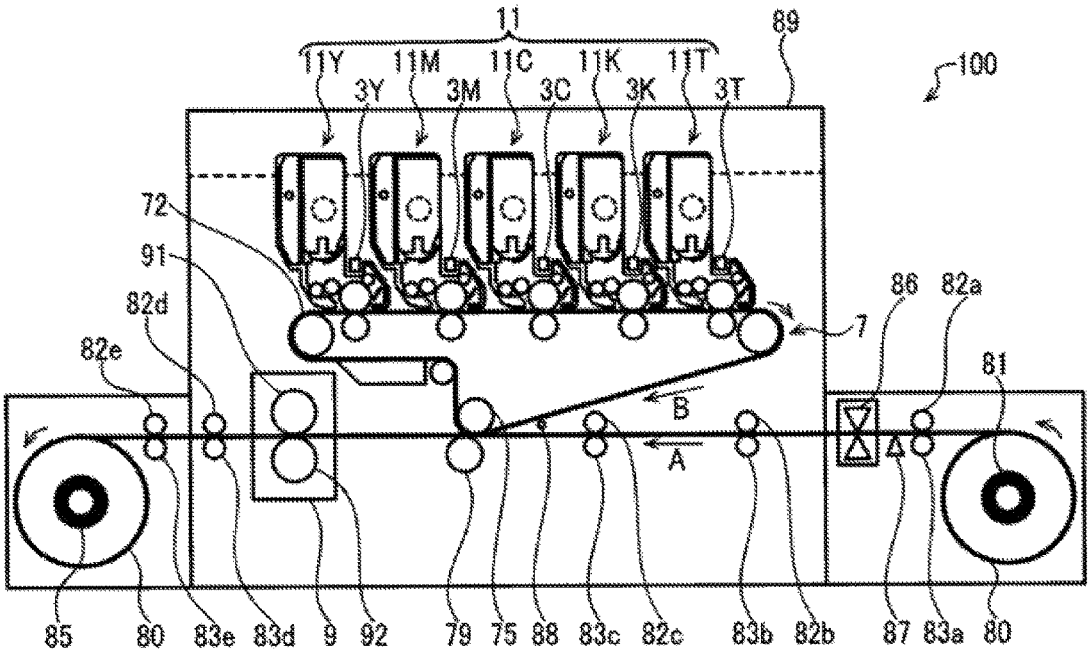
FIG. 1 is a schematic side sectional view showing a configuration of an image forming apparatus in an embodiment.

FIG. 1 is a schematic side cross-sectional view illustrating a configuration of an image forming apparatus of an embodiment. In FIG. 1, an image forming apparatus 100 continuously prints on continuous print medium, and is, for example, an intermediate transfer type printer having an intermediate transfer unit 7. The image forming apparatus 100 of the present embodiment performs continuous printing (hereinafter referred to as "roll/roll printing") on a roll-like continuous print medium.

The image forming apparatus 100 includes a medium holder 81, carrying rollers 82*a*-82*e*, pinch rollers 83*a*-83*e*, an intermediate transfer unit 7, development units 11, a secondary transfer roller 79, a fuser 9, a winding holder 85, a cutter unit 86, a medium detection sensor 87, and a separating bar 88.

The medium holder 81 winds and holds a print medium 80 in a roll-like shape. The carrying rollers 82*a*-82*e* as a carrying means carry the print medium 80 drawn from the medium holder 81. The pinch rollers 83*a*-83*e* are arranged opposing the carrying rollers 82*a*-82*e* across a medium carrying path, and the print medium 80 is sandwiched between the pinch rollers 83*a*-83*e* and the carrying rollers 82*a*-82*e*.

The carrying roller 82*a* and the pinch roller 83*a*, the carrying roller 82*b* and the pinch roller 83*b*, the carrying roller 82*c* and the pinch roller 83*c*, the carrying roller 82*d* and the pinch roller 83*d*, and the carrying roller 82*e* and the pinch roller 83*e* are arranged opposing each other. From an upstream side in a medium carrying direction indicated by an arrow A in the drawing, the carrying roller 82*a* and the pinch roller 83*a,* the carrying roller 82*b* and the pinch roller 83*b,* the carrying roller 82*c* and the pinch roller 83*c,* the carrying roller 82*d* and the pinch roller 83*d,* and the carrying roller 82*e* and the pinch roller 83*e* are arranged in this order.

The intermediate transfer unit 7 as an intermediate transfer part is arranged above the medium carrying path and carries a toner image formed by the development units 11 on a belt 72.

The development units 11 as image forming parts are arranged above the intermediate transfer unit 7. From an upstream side in a belt carrying (rotation) direction indicated by an arrow B in the drawing, a development unit 11Y handling a yellow toner, a development unit 11M handling a magenta toner, a development unit 11C handling a cyan toner, a development unit 11K handling a black toner, and a development unit 11T handling a toner of a special color are arranged in this order.

The development units 11 each form a toner image as a developer image using a toner as a developer. In the present embodiment, the development unit 11T is described as a development unit handling a white toner. However, besides a white toner, it is also possible that the development unit 11T is a development unit handling a clear toner, a gold color toner, a silver color toner, a neon toner, or the like.

Further, the image forming apparatus 100 is described as a configuration having five development units. However, it is also possible that the image forming apparatus 100 is a configuration having four or less, or six or more development units. A light source 3Y, a light source 3M, a light source 3C, a light source 3K, and a light source 3T, as an exposure means, are respectively arranged above the development unit 11Y, the development unit 11M, the development unit 11C, the development unit 11K, and the development unit 11T.

In the present embodiment, the light source 3Y, the light source 3M, the light source 3C, the light source 3K, and the light source 3T each use an LED head in which a plurality of LEDs (Light Emitting Diodes) are arranged in a main scanning direction. The light sources may emit laser or the like. The secondary transfer roller 79 as a transfer part is arranged opposing a support roller 75 of the intermediate transfer unit 7 across the belt 72. The secondary transfer roller 79 transfers, to the print medium 80, a toner image (toner image formed by the development unit 11) carried by the belt 72.

The secondary transfer roller 79 of the present embodiment is pressed by the intermediate transfer unit 7 during a print operation. Further, except during a print operation, the secondary transfer roller 79 is separated from the intermediate transfer unit 7 and the print medium 80 by an actuator. The fuser 9 as a fuser part is arranged on a downstream side of the secondary transfer roller 79 in the medium carrying direction and fuses a toner image to the print medium 80, to which the toner image has been transferred, by applying heat and pressure.

The fuser 9 has a heat application roller 91 for applying heat to the toner transferred onto the print medium 80 and a pressure application roller 92 for applying pressure to the toner transferred onto the print medium 80. The heat application roller 91 and the pressure application roller 92 are arranged opposing each other across the medium carrying path. The winding holder 85 is arranged on a downstream side of the fuser 9 in the medium carrying direction and winds up the print medium 80 on which the toner is fused.

The cutter unit 86 is arranged between the carrying roller 82*a* and the carrying roller 82*b* and sandwiches the medium carrying path, and cuts the print medium 80 carried on the medium carrying path. The medium detection sensor 87 is arranged under the medium carrying path on an upstream side of the cutter unit 86 in the medium carrying direction, and is a sensor for detecting the print medium 80.

When the secondary transfer roller 79 separates from the intermediate transfer unit 7, the separating bar 88 moves together with the secondary transfer roller 79 to separate the print medium 80 from the intermediate transfer unit 7. On an upper part of the image forming apparatus 100, a cover 89 is provided as a lid part that is rotatably supported on a rotation shaft and is openable and closable with respect to a main body of the image forming apparatus 100. The cover 89 is not limited to be provided on the upper part of the image forming apparatus 100. It is also possible that the cover 89 is provided on a front side or a lateral side of the image forming apparatus 100 as long as the cover 89 is openable and closable with respect to the main body of the image forming apparatus 100.

In the present embodiment image forming apparatus 100, by opening the cover 89 with respect to the image forming apparatus 100 body, the development units 11 (11Y, 11M, 11C, 11K, 11T), the intermediate transfer unit 7, the secondary transfer roller 79, and the fuser 9 are each attachable and detachable with respect to the image forming apparatus 100 body and can each be replaced.

Figure 2:
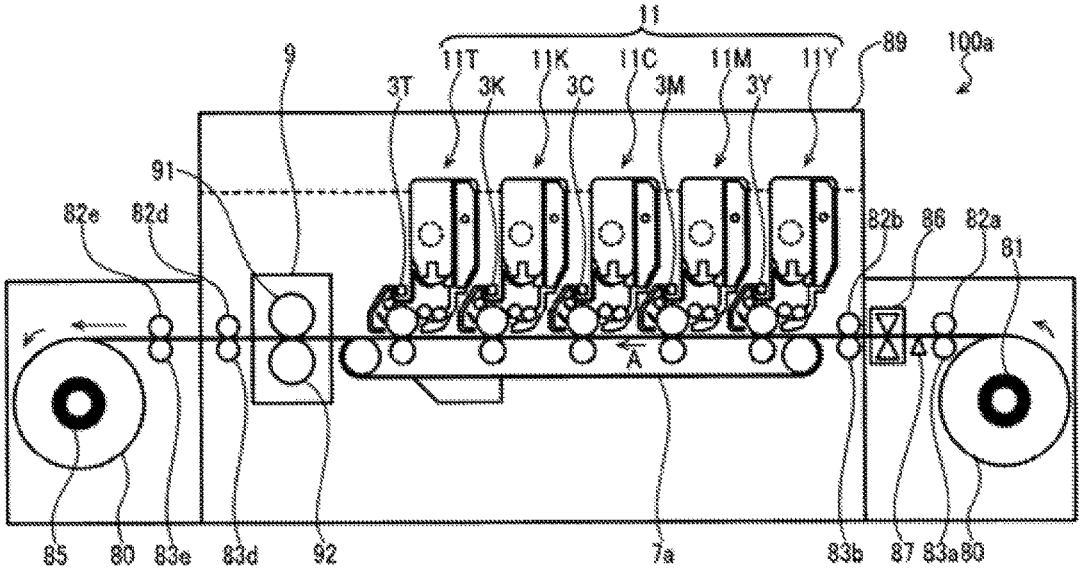
FIG. 2 is a schematic side sectional view showing a configuration of an image forming apparatus (direct transfer system a embodiment.

In the present embodiment, the image forming apparatus 100 is described as an intermediate transfer type printer. However, the present invention is not limited to this. As illustrated in FIG. 2, it is also possible that an image forming apparatus 100*a* is a direct transfer type printer that has a transfer belt 7*a* and directly transfers a toner image formed by the development units 11 to the print medium 80 carried by the transfer belt 7*a*.

Figure 3:
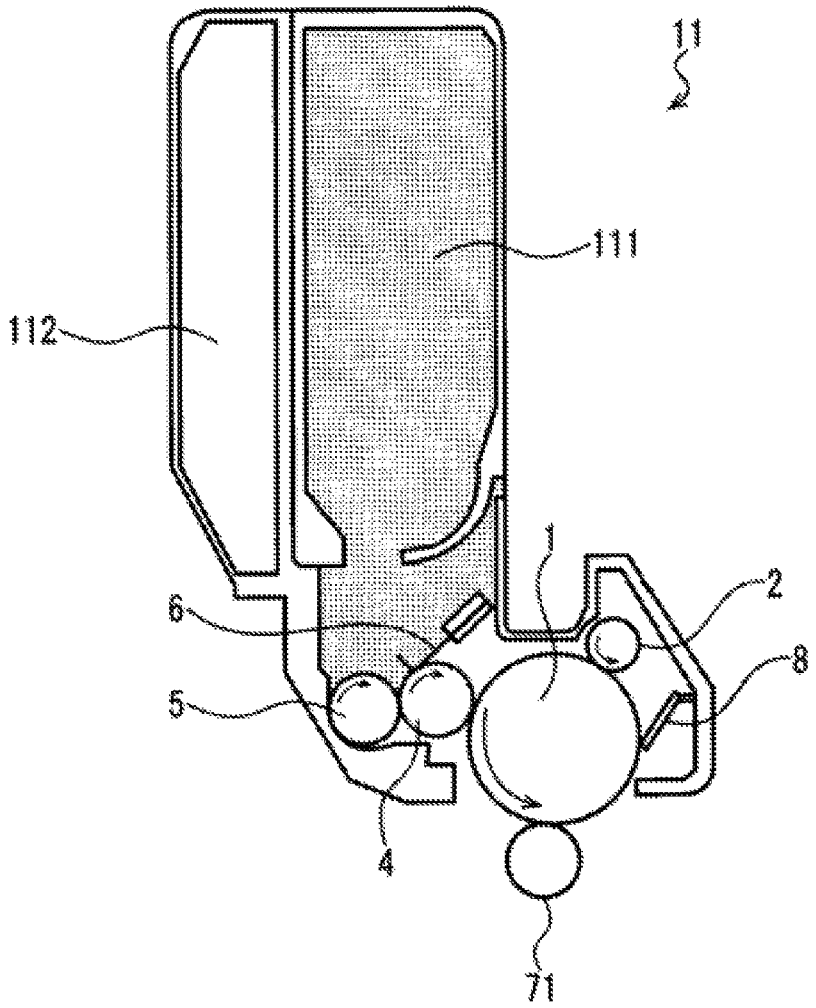
FIG. 3 is a schematic side sectional view showing a configuration of a development unit in the embodiment.

FIG. 3 is a schematic side cross-sectional view illustrating a configuration of a development unit of an embodiment. The development unit 11Y, the development unit 11M, the development unit 11C, the development unit 11K and the development unit 11T illustrates in FIG. 1 respectively handle different toners, but have the same configuration. Therefore, the configuration of only one development unit is described.

In FIG. 3, the development unit 11 has a toner container 111, a photosensitive drum 1, a charging roller 2, a development roller 4, a supply roller 5, a development blade 6, a cleaning device 8, and a waste toner container 112.

The toner container 111 as a developer container contains therein a toner. The photosensitive drum 1 as an image carrier is rotatably supported and, by selectively exposing the photosensitive drum 1 to the light source 3 (Y, M, C, K, T) illustrated in FIG. 1, an electrostatic latent image is formed thereon. The charging roller 2 as a charging means uniformly charges a surface of the photosensitive drum 1.

The development roller 4 as a developing means carries toner to an electrostatic latent image formed on the photosensitive drum 1 to develop a toner image. The supply roller 5 as a supply means supplies toner to the development roller 4. The development blade 6 as a regulating means forms a uniform toner layer on the development roller 4.

The cleaning device 8 as a developer removing means scrapes off residual toner such as transfer residual toner remaining on the photosensitive drum 1. The waste toner container 112 as a waste developer container contains the toner scraped off by the cleaning device 8. The charging roller 2, the development roller 4 and the cleaning device 8 are arranged to press against the surface of the photosensitive drum 1 while maintaining a predetermined contact amount.

The development blade 6 and the supply roller 5 are arranged to press against the development roller 4 while maintaining a predetermined contact amount. In the development roller 4, a semiconductive elastic layer is formed on a circumferential surface of a cylindrical metal shaft. For the elastic layer, a urethane rubber is used, and a surface of the elastic layer is subjected to an isocyanate treatment in order to enhance chargeability.

In the supply roller 5, a semiconductive foamed elastic layer is formed on a circumferential surface of a cylindrical metal shaft. A silicone rubber excellent in abrasion resistance is used for the foamed elastic layer. The development blade 6 is formed by bending a SUS plate into an L shape, and is arranged such that a long portion of the development blade 6 is on a downstream side in a rotation direction of the development roller 4 indicated by an arrow in the drawing, and is arranged such that a bent edge part is pressed against the development roller 4 in a counter direction.

Figure 4A:
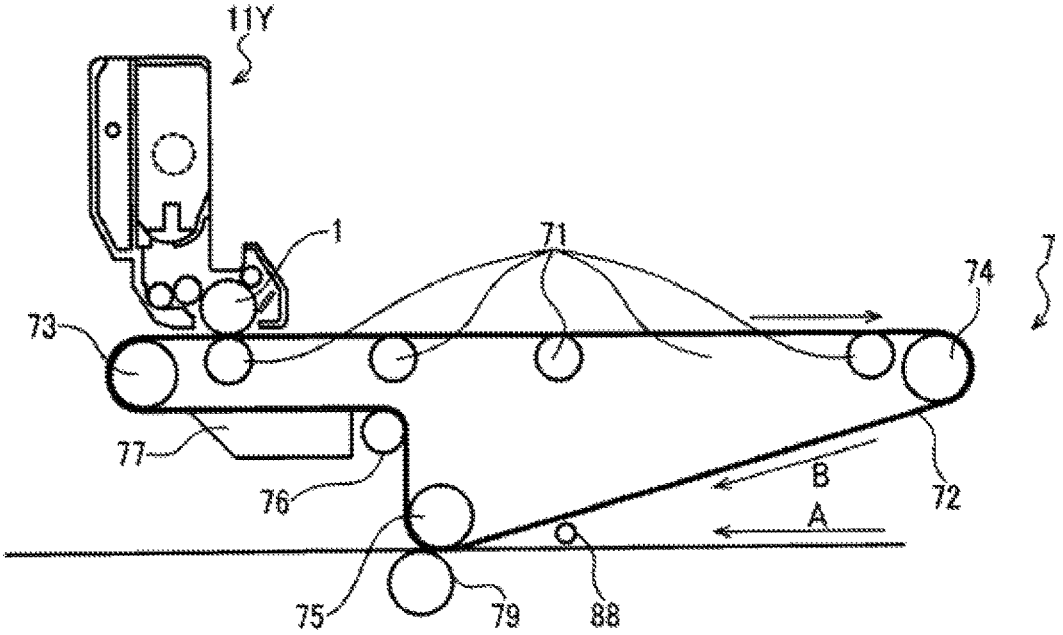
FIGS. 4A and 4B are schematic side sectional views showing a configuration of an intermediate transfer unit in the embodiment.
Figure 4B:
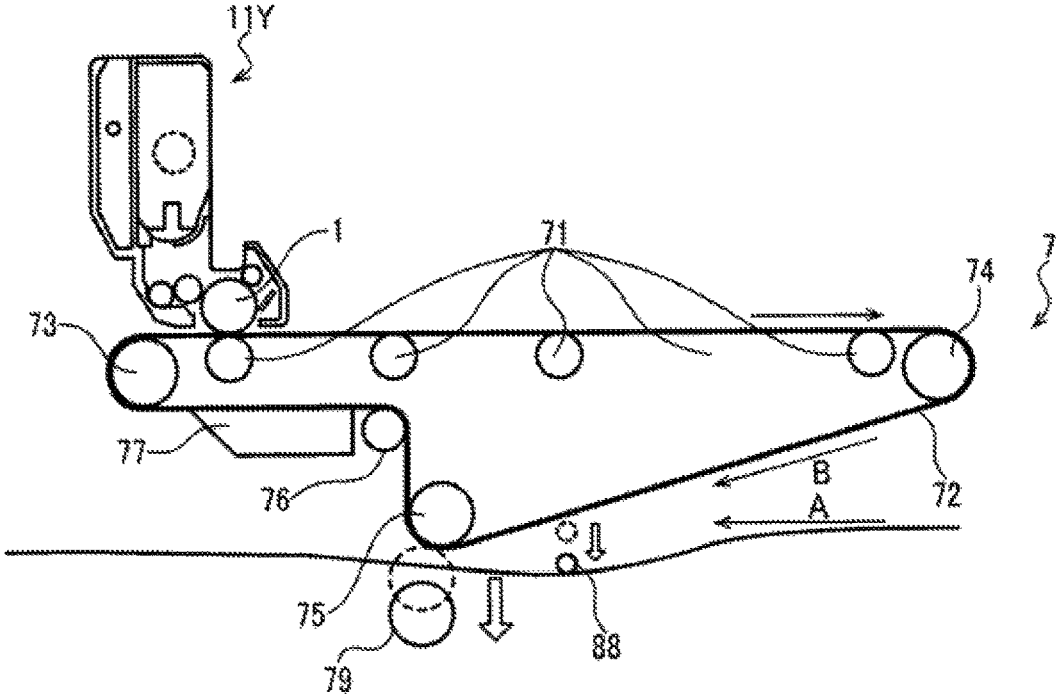

FIGS. 4A and 4B are schematic side cross-sectional views illustrating a configuration of the intermediate transfer unit of an embodiment. FIG. 4A illustrates a state in which the secondary transfer roller 79 is pressed against the intermediate transfer unit 7. FIG. 4B illustrates a state in which the secondary transfer roller 79 is separated from the intermediate transfer unit 7. In FIGS. 4A and 4B, the intermediate transfer unit 7 has primary transfer rollers 71, a belt 72, a drive roller 73, support rollers 74, 75, a reverse bending roller 76, and a waste toner box 77.

The primary transfer rollers 71 are respectively arranged opposing the photosensitive drums 1 (see FIG. 3) of the development units across the belt 72. The primary transfer rollers 71 transfer toner images formed on the photosensitive drums to the belt 72. The belt 72 is an endlessly rotatable belt stretched over the drive roller 73, the support rollers 74, 75, and the reverse bending roller 76, and carried a toner image.

The drive roller 73 is rotated by a drive source such as a motor, and rotates the belt 72 in a rotation direction indicated by an arrow B in the drawings The support rollers 74, 75 are driven rollers and, together with the drive roller 73, stretch the belt 72 at a predetermined stretching pressure.

The reverse bending roller 76 reversely bends the belt 72. The waste toner box 77 scrapes off and collects toner remaining on the belt 72 when an toner image on belt 72 is transferred to the print medium 80 by the secondary transfer roller 79.

Figure 5:
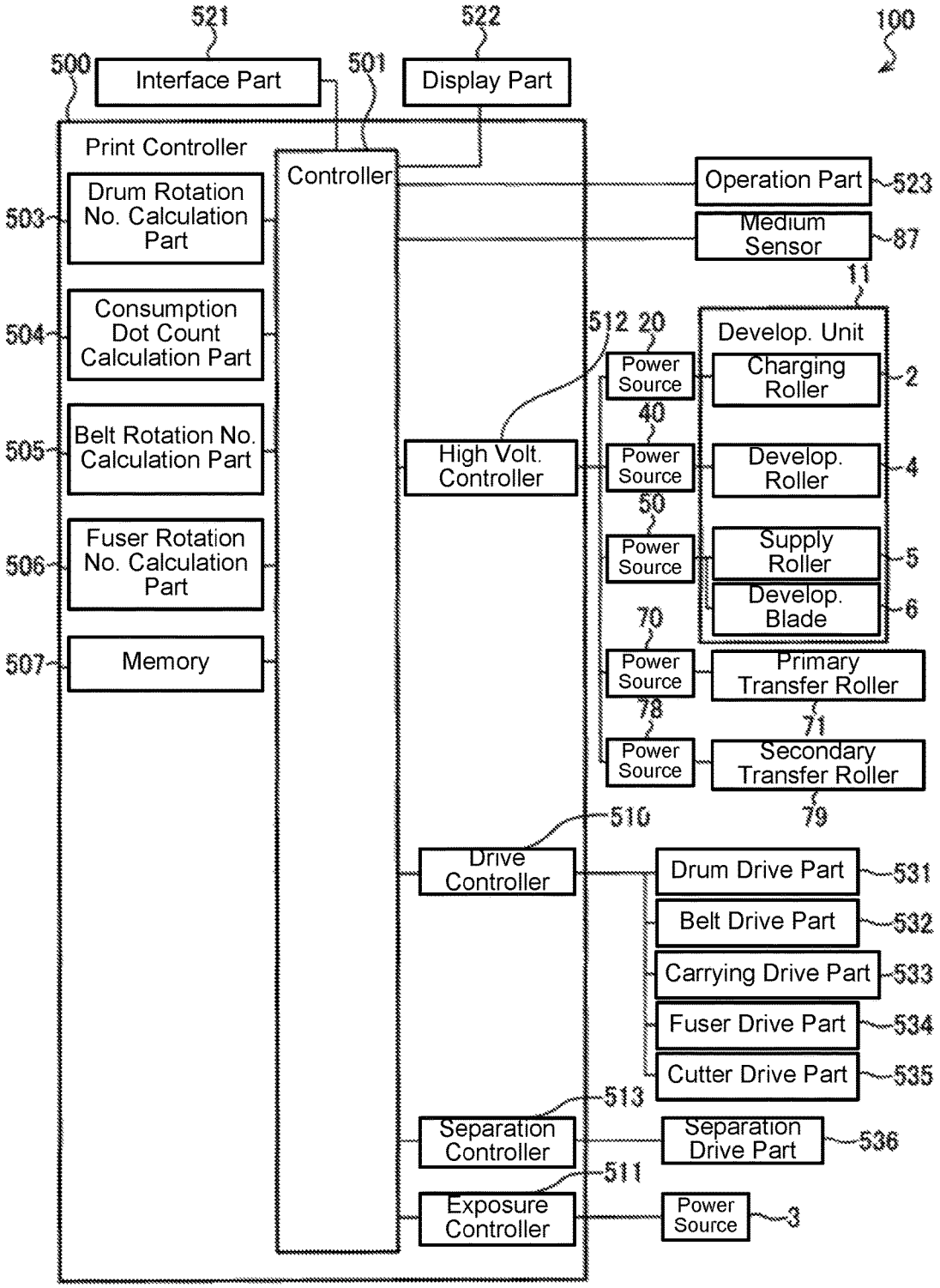
FIG. 5 is a block diagram showing a control configuration of an image forming apparatus in the embodiment.

FIG. 5 is a block diagram illustrating a control configuration of the image forming apparatus of the embodiment. In the following, the control configuration of the image forming apparatus is described based on FIG. 5 with reference to FIG. 1.

In FIG. 5, the image forming apparatus 100 includes a print controller 500, an interface part 521, a display part 522, an operation part 523, a medium sensor 87, power sources 20, 40, 50, 70, 78, a drum drive part 531, a belt drive part 532, a carrying drive part 533, a fuser drive part 534, a cutter drive part 535, and a separation drive part 536.

The interface part 521 exchanges various control signals with a host computer as an external device connected to a communication line and performs transmission and reception of information, and receive print data or the like that instructs printing from the host computer.

The display part 522 is provided with a display means such as a display and displays information indicating a state of the image forming apparatus 100. When a development unit 11 illustrated in FIG. 1, which is an expendable item, reaches its end of life, the display part 522 displays a warning or the like prompting a user of the image forming apparatus 100 to replace the development unit 11.

The operation part 523 is provided with an input means such as operation buttons or a touch panel, and accepts an input operation of a user. When the development units 11 (11Y, 11M, 11C, 11K, 11T), the intermediate transfer unit 7, the secondary transfer roller 79, and the fuser 9 illustrated in FIG. 1, which are expendable items, have reached their end of life during an print operation, the operation part 523 accepts a setting operation selecting whether or not to cut the print medium. In the present embodiment, the operation part 523 accepts a user setting operation selecting whether or not to cut the print medium in advance, and performs setting by storing, in a memory 507, information about whether or not to cut the print medium when an expendable item reaches its end of life during a print operation.

In the invention, the operation part 523 works as a selection part that functions to receive an input from the operator. The input indicates whether or not to cut the medium.

The print controller 500 controls a print operation performed by the image forming apparatus 100. The print controller 500 includes a controller 501, a drum rotation number calculation part 503, a consumption dot count calculation part 504, a belt rotation number calculation part 505, a fuser rotation number calculation part 506, a memory 507, a high voltage controller 512, a drive controller 510, an exposure controller 511, and a separation controller 513.

The controller 501 has a control means such as a CPU (Central Processing Unit) and controls an overall operation of the image formation apparatus 100 based on a control program stored in the memory 507. The controller 501 exchanges signals with the display part 522, the operation part 523 and the medium sensor 87.

As usage detection parts, the drum rotation number calculation part 503, the consumption dot count calculation part 504, the belt rotation number calculation part 505 and the fuser rotation number calculation part 506 detect usage of the development unit 11, the intermediate transfer unit 7, secondary transfer roller 79 and the fuser 9, which are illustrated in FIG. 1 as a plurality of replacement parts.

The usage detection part is one example of a condition detection part. The condition detection part functions to detect and monitor any types of condition with respect to the replacement parts. These conditions includes temperatures, humidifies, working periods, calendar schedules, days of week, names of operators, types of images to be developed, etc. as well as usage data.

The drum rotation number calculation part 503 measures a rotation number of the photosensitive drum 1 illustrated in FIG. 3 which is rotated by the drive controller 510. In the present embodiment, the drum rotation number calculation part 503 measures 5 rotations of the photosensitive drum 1 having an outer diameter φ of 30 mm as 1 drum count (471.2 mm), and respectively measures drum counts Rn (Ry, Rm, Rc, Rk, Rt) for the development units 11 (11Y, 11M, 11C, 11K, 11T) illustrated in FIG. 1. In this applicant, the attached symbol, "n" represents one of yellow, magenta, cyan, black, special color that corresponds to a color of toner contained in the container.

The drum count Ry is a cumulative value of the drum count of the development unit 11Y; the drum count Rm is a cumulative value of the drum count of the development unit 11M; the drum count Rc is a cumulative value of the drum count of the development unit 11C; the drum count Rk is a cumulative value of the drum count of the development unit 11K; and the drum count Rt is a cumulative value of the drum count of the development unit 11T.

When a drum count Rn (any one of the drum counts Ry, Rm, Rc, Rk, Rt) reaches 20,000 as a threshold, the controller 501 determines that the development unit 11 has reached its end of life. The term "determining" means that it is detected that the end of life has been reached.

Based on the print data received by the interface part 521, the consumption dot count calculation part 504 respectively calculates consumption dot counts Dy, Dm, Dc, Dk, Dt for the development units 11 (11Y, 11M, 11C, 11K, 11T) for each print job. The consumption dot count calculation part 504 obtains a usage amount of yellow (Y) based on the print data and calculates the consumption dot count Dy by converting the usage amount to a value in dot units. Similarly, the consumption dot count calculation part 504 obtains a usage amount for a toner of each color and calculates a consumption dot count Dn.

The consumption dot count Dy is a cumulative value of the consumption dot count of the development unit 11Y; the consumption dot count Dm is a cumulative value of the consumption dot count of the development unit 11M; the consumption dot count Dc is a cumulative value of the consumption dot count of the development unit 11C; the consumption dot count Dk is a cumulative value of the consumption dot count of the development unit 11K; and the consumption dot count Dt is a cumulative value of the consumption dot count of the development unit 11T.

In the present embodiment, on an A4 sheet (210 mm×297 mm), a consumption dot count in a case of printing one image having a print area ratio of 5% Duty is defined as 792.

When the consumption dot count Dn (any one of the consumption dot counts Dy, Dm, Dc, Dk, Dt) reaches 15,840,000 as a threshold (this corresponds to printing 20,000 sheets in the case of printing one 5% duty image on one A4 sheet), the controller 501 determines that the development unit 11 has reached its end of life.

In the present embodiment, the development units 11 (11Y, 11M, 11C, 11K, 11T) that have been determined to have reached their end of life are taken out by opening the cover 89 that is provided openable and closable to the image forming apparatus 100, and are replaced with new development units 11 (11Y, 11M, 11C, 11K, 11T). The development units 11Y, 11M, 11C, 11K, 11T can each be individually replaced.

The belt rotation number calculation part 505 measures a belt count Bn which is a rotation number of the belt 72 of the intermediate transfer unit 7 illustrated in FIG. 1 rotated by the belt drive part 532. Further, the belt rotation number calculation part 505 also measures a transfer count Tn which is a rotation number of the secondary transfer roller 79 which is driven to rotate by the belt 72.

In the present embodiment, a distance corresponding to a distance that the circumferential surface of the photosensitive drum 1 illustrated in FIG. 3 moves in 1 drum count Rn is defines as 1 belt count in a case where the belt 72 moves, and is defined as 1 transfer count (471.2 mm) in a case where the circumferential surface of the secondary transfer roller 79 moves, and the belt rotation number calculation part 505 measures a belt count Bn and a transfer count Tn.

When the belt count Bn reaches 120,000, the controller 501 determines that the intermediate transfer unit 7 has reached its end of life. Further, when the transfer count Tn reaches 100,000, the controller 501 determines that the secondary transfer roller 79 has reached its end of life.

Further, in the present embodiment, the intermediate transfer unit 7 and the secondary transfer roller 79, which have been determined to have reached their end of life, are taken out by opening the cover 89 that is provided openable and closable on the upper part of the image forming apparatus 100, and are replaced with a new intermediate transfer unit 7 and a new secondary transfer roller 79.

The fuser rotation number calculation part 506 measures a fuser count Fn which is a rotation number of the heat application roller 91 of the fuser 9 illustrated in FIG. 1 rotated by the fuser drive part 534. In the present embodiment, a distance corresponding to a distance that the circumferential surface of the photosensitive drum 1 illustrated in FIG. 3 moves in 1 drum count Rn is defines as 1 fuser count in a case where the circumferential surface of the heat application roller 91 moves, and the fuser rotation number calculation part 506 measures a fuser count Fn.

When the fuser count Fn reaches 90,000, the controller 501 determines that the fuser 9 has reached its end of life. Further, in the present embodiment, the fuser 9 that has been determined to have reached its end of life is taken out by opening the cover 89 that is provided openable and closable on the upper part of the image forming apparatus 100, and is replaced with a new fuser 9. Here, expendable items as replacement parts of the image forming apparatus 100 of the present embodiment is described with reference to FIG. 1.

In the present embodiment, in a case where an expendable item reaches its end of life during a roll/roll printing operation performed by the image forming apparatus 100 and the print operation is stopped, the expendable item is referred to as an "A-type expendable item" when it is necessary to remove the print medium 80 remaining in the image forming apparatus 100, and is referred to as a "B-type expendable item" when it is not necessary to remove the the print medium 80 remaining in the image forming apparatus 100.

The development units 11 and the intermediate transfer unit 7 of the image forming apparatus 100 are arranged above the print medium 80 (that is, between the medium carrying path and the cover 89) and can be replaced by opening the cover 89 on the upper part of the image forming apparatus 100 so that it is not necessary to remove the print medium 80, and thus are "B-type expendable items." Further, toner cartridges, drum cartridges, and the like that are detachable with respect to the development units 11 are "B-type expendable items." These B-type expendable items may be determined if reaching end of life by using a sensor to detect a remaining toner amount, to count drum rotations, or to detect toner density of developed images on the medium. Also, these items may be determined by calculating a medium carried distance.

On the other hand, the secondary transfer roller 79 of the image forming apparatus 100 is arranged below the print medium 80 and is replaced by opening the cover 89 on the upper part of the image forming apparatus 100 so that it is necessary to remove the print medium 80, and thus is an "A-type expendable item."

Further, the fuser 9 of the image forming apparatus 100 is arranged to sandwich the print medium 80 so that it is necessary to remove the print medium 80 when the fuser 9 is replaced, and thus is an "A-type expendable item."

In the present embodiment, it is described that the cover that can be opened and closed is arranged on the upper part of the image forming apparatus 100. However, it is also possible to have a configuration in which a cover that can be opened and closed is provided on a front side or a back side of the image forming apparatus 100, and the development units 11, the intermediate transfer unit 7 and the secondary transfer roller 79 can be taken out by sliding the cover from a lateral side of the image forming apparatus 100. In this case, since it is not necessary to remove the print medium 80, the secondary transfer roller 79 is a "B-type expendable item."

Further, in the case of the direct transfer type image forming apparatus 100 illustrated in FIG. 2, a transfer unit 7*a* is replaced by opening the cover 89 on the upper part of the image forming apparatus 100 so that it is not necessary to remove the print medium 80, and thus is an "A-type expendable item."

The memory 507 is a storage means such as a memory and stores a control program executed by the controller 501 and various control information and setting information and the like necessary for controlling the operation of the image forming apparatus 100.

Further, the memory 507 stores the drum counts Rn (Ry, Rm, Rc, Rk, Rt) calculated by the drum rotation number calculation part 503, the consumption dot counts Dn (Dy, Dm, Dc, Dk, Dt) calculated by the consumption dot count calculation part 504, the belt count Bn and the transfer count Tn calculated by the belt rotation number calculation part 505, and the fuser count Fn calculated by the fuser rotation number calculation part 506.

Further, the memory 507 stores in advance a threshold Rlimit for determining a lifespan of the development units by the drum count Rn, a threshold Dlimit for determining a lifespan of the development unit by the consumption dot count Dn, a threshold Blimit for determining a lifespan of the intermediate transfer unit by the belt count Bn, a threshold Tlimit for determining a lifespan of the secondary transfer roller by the transfer count Tn, and a threshold Flimit for determining a lifespan of the fuser by the fuser count Fn.

The high voltage controller 512 controls a power source 20 connected to the charging roller 2, a power source 40 connected to the development roller 4, a power source 50 connected to the supply roller 5 and the development blade 6, a power source 70 connected to the primary transfer roller 71, and a power source 78 connected to the secondary transfer roller 79, and controls voltages applied to the charging roller 2, the development roller 4, the supply roller 5, the development blade 6, the primary transfer roller 71, and the secondary transfer roller 79.

The drive controller 510 controls the drum drive part 531, the belt drive part 532, the carrying drive part 533, the fuser drive part 534, and the cutter drive part 535.

The drum drive part 531 drives the photosensitive drum 1 of the development unit 11 illustrated in FIG. 3. The belt drive part 532 drives the belt 72 of the intermediate transfer unit 7 illustrated in FIGS. 4A and 4B. The carrying drive part 533 as a medium carrying part drives the carrying rollers 82*a*-82*e* illustrated in FIG. 1 arranged in a carrying path along which the medium is carried, and carries the continuous medium.

The fuser drive part 534 drives the heat application roller 91 of the fuser 9 illustrated in FIG. 1. The cutter drive part 535 as a cutting part drives the cutter unit 86 illustrated in FIG. 1 and cuts the continuous medium. The exposure controller 511 drives the light sources 3.

In this way, the controller 501 of the present embodiment controls the drum rotation number calculation part 503, the consumption dot count calculation part 504, the belt rotation number calculation part 505, the fuser rotation number calculation part 506, the memory 507, the high voltage controller 512, the drive controller 510 and the exposure controller 511, and, based on detection results of the usages of the plurality of replacement parts the development units 11, the intermediate transfer unit 7, the secondary transfer roller 79 and the fuser 9 illustrated in FIG. 1) by the drum rotation number calculation part 503, the consumption dot count calculation part 504, the belt rotation number calculation part 505 and the fuser rotation number calculation part 506, determines whether or not each of the replacement parts has reach its end of life.

Further, when any one of the replacement parts reaches its end of life during a print operation and printing is stopped, the controller 501 selects whether or not to cut the medium in accordance with the type of the replacement part that has reached its end of life and the setting information (selection information by the operator) stored in the memory 507 regarding whether or not cutting is necessary.

More specifically, replacement parts are classified as "B-type expendable items" into first replacement parts for which it is not necessary to remove the medium at the time of replacement and "A-type expendable items" as second replacement parts for which it is necessary to remove the medium at the time of exchange. When a "B-type expendable item" as a first replacement part has reached its end of life, the controller 501 selects whether or not to cut the medium according to the setting information (selection information by the operator) stored in the memory 507 regarding whether or not cutting is necessary.

The controller 501 of the present embodiment cuts the medium according to the setting information indicating that cutting is necessary which is set using the operation part 523. The selection information is an operator's choice and input by an operator with the operation part before the print process starts.

In the present embodiment, a toner amount in the development unit is detected using a method in which a consumed toner amount is calculated based on a dot count. However, it is also possible to other methods as long as the methods allow the toner amount in the development unit to be detected. For example, it is also possible to use a method in which a crank bar is rotated in the toner container 111 of the development unit 11 illustrated in FIG. 3 and the toner amount is detected based on a difference in a fall speed of the crank bar, or to use a method in which light such as laser is irradiated into the development unit 11 through a prism and the toner amount is detected based on light transmittance.

An effect of the above-described configuration is described.

An operation of printing onto a continuous print medium performed by the image forming apparatus is described based on FIG. 1 with reference to FIG. 5. First, a carrying operation in the case of printing onto the continuous print medium 80 wound in a roll-like shape is described.

Before the carrying operation of the print medium 80 is started, as illustrated in FIG. 4A, due to the separation driving part 536, the secondary transfer roller 79 moves upward and becomes in contact with the support roller 75 of the intermediate transfer unit 7, and the separating bar 88 moves to above the print medium 80 in the medium carrying path.

The roll-shaped print medium 80 held by the medium holder 81 is sandwiched between the carrying rollers 82*a*-82*c* and the pinch rollers 83*a*-83*c* rotated by a drive part such as a motor and is carried to the intermediate transfer unit 7. A toner image developed on the belt 72 of the intermediate transfer unit 7 is transferred onto the print medium 80 by the secondary transfer roller 79.

The print medium 80 onto which the toner image has been transferred is carried to the fuser 9, and is heated and pressed by the fuser 9, and the toner image is fused on the print medium 80. The print medium 80 on which the toner image is fused is sandwiched by the carrying rollers 82*d*, 82*e* and the pinch rollers 83*d*, 83*e* which are rotated by a drive source, and is carried to the winding holder 85.

The print medium 80 carried to the winding holder 85 is wound into a roll-like shape by the winding holder 85 rotating in a winding direction (counterclockwise rotation direction) indicated by an arrow in the drawing. In the present embodiment, the rotation direction of the winding holder 85 is set as the counterclockwise rotation direction so that the printed side faces outward. However, it is also possible that the rotation direction of the winding holder 85 is set to a clockwise rotation direction so that the print side faces inward.

Next, a carrying operation of the print medium 80 after the ending of the print operation is described. For the carrying operation of the print medium 80 after the ending of the print operation, there are two operations: one operation is to stop printing by cutting the print medium 80 at the final page, and the other operation is to stop printing without cutting the print medium 80 at the final page.

In the case of the operation of stopping by cutting the print medium 80 at the final page, the controller 501 controls the medium sensor 87 to detect a length of the print medium 80 passed through, and, when the final page passes through the cutter unit 86, the controller 501 controls the cutter drive part 535 to drive the cutter unit 86 to cut the print medium 80.

When the print medium 80 is cut, the controller 501 stops the driving of the carrying roller 82*a* by the carried drive part 533 and stops the carrying of the print medium 80 on the upstream side of the cutter unit 86 in the carrying direction of the cut medium.

Further, the controller 501 carries the print medium 80 on the downstream side of the cutter unit 86 in the carrying direction of the cut medium with the carrying rollers 82*b*-82*e* driven by the carrying driving part 533. When a trailing edge of the print medium 80 passes through the carrying roller 82*e*, the controller 501 stops the driving of the carrying rollers 82*b*-82*e* by the carrying driving part 533, and ends the carrying operation of the print medium 80 after the ending of the print operation.

In the case of the operation of stopping without cutting the print medium 80 at the final page, the controller 501 controls the medium sensor 87 to detect a length of the print medium 80 passed through, and carries the print medium 80 until the final page passes through the carrying roller 82*e*, and, when the final page passes through the carrying roller 82*e*, the controller 501 ends the carrying operation of the print medium 80 after the ending of the print operation by controlling the carrying drive part 533 to stop the driving of the driving rollers 82*a*-82*e*.

When the carrying operation of the print medium 80 after the ending of the print operation is ended, as illustrated in FIG. 4B, the controller 501 controls the separation controller 513 to move the secondary transfer roller 79 downward to be separated from the support roller 75 of the intermediate transfer unit 7, and also move the separating bar 88 downward to separate the print medium 80 in the medium carrying path from the intermediate transfer unit 7.

Next, a toner image forming operation performed by a development unit is described based on FIG. 3 with reference to FIG. 5.

The photosensitive drum 1 of the development unit 11 is driven by the drum drive part 531 and rotates in the counterclockwise rotation direction indicated by the arrow in the drawing. The charging roller 2 to which a voltage is applied by the power source 20 charges the surface of the photosensitive drum 1 to about −600 V.

Light is irradiated from the light source 3 according to the print data to the surface of the photosensitive drum 1 charged by the charging roller 2. The surface of the photosensitive drum 1 irradiated with light has an electric potential 0-−600 V, and an electrostatic latent image is formed. On the other hand, the toner filled in the toner container 111 is carried to the supply roller 5 by free fall. It is also possible that the toner is carried to the supply roller 5 by a carrying member.

The development roller 4 and the supply roller 5 rotate in a clockwise rotation direction indicated by an arrow in the drawing due to a driving force transmitted from the photosensitive drum 1 via gears or the like, and thereby, the toner is carried from the supply roller 5 to the development roller 4.

In this case, the toner is frictionally charged by being rubbed against the development roller 4, the supply roller 5 and the development blade 6, and is negatively charged.

Further, a voltage in a range of (−250)-(−400) V is applied to the supply roller 5 and the development blade 6 by the power source 50, and a voltage in a range of (−100)-(−200) V is applied to the development roller 4 by the power source 40. Therefore, a potential difference is generated between the supply roller 5 and the development roller 4, and between the development roller 4 and the development blade 6. Due to the potential difference, the negatively charged toner is carried from the supply roller 5 to the development roller 4 by a Coulomb force.

Since variation in thickness occurs in the layer of the toner on the development roller 4 formed by the toner carried to the development roller 4, the excessive toner on the development roller 4 is scraped off by the edge part of the development blade 6, and negatively charged toner is selected to formed a uniform toner layer on the development roller 4.

Since a potential difference is generated between the development roller 4 and the photosensitive drum 1, the toner of the toner layer uniformly formed on the development roller 4 is carried to the electrostatic latent image which is an exposure part on the photosensitive drum 1 by a Coulomb force, and the toner image is developed.

A voltage in a range of (+800)-(+1600) V is applied to the primary transfer roller 71 by the power source 70. Due to a potential difference between the photosensitive drum 1 and the primary transfer roller 71, the toner image formed on the photosensitive drum 1 is transferred from the surface of the photosensitive drum 1 to the belt 72.

The toner that remains on the photosensitive drum 1 without being transferred to the belt 72 is scraped off by the cleaning device 8, and the photosensitive drum 1 is cleaned. The scraped toner as a waste toner is carried to the waste toner container 112 by a carrying means.

Figure 6:
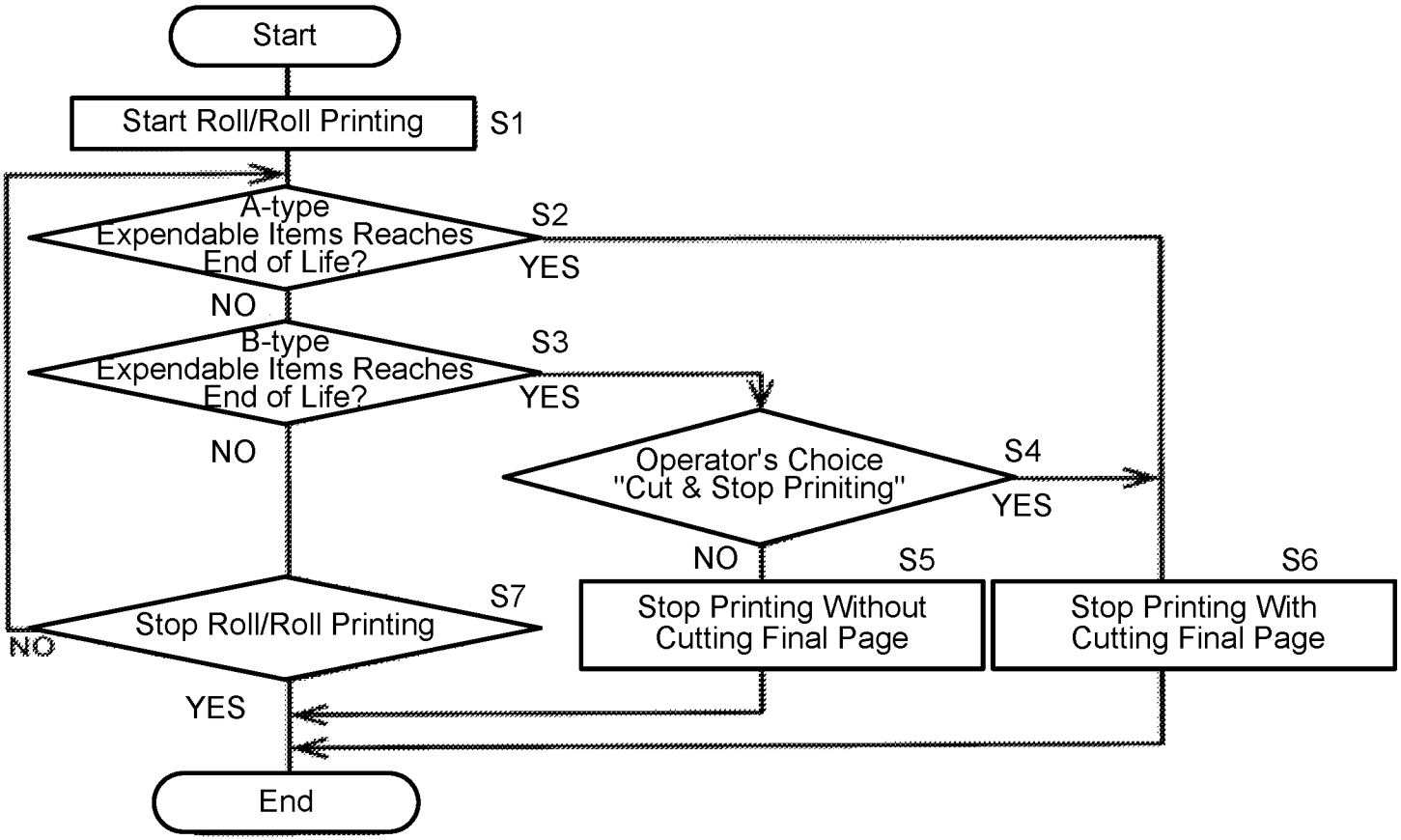
FIG. 6 is a flowchart showing a flow of printing processes in the embodiment.

Next, in a case where the development unit, the intermediate transfer unit, the secondary transfer roller or the fuser reaches its end of life during a print operation, a print process performed by the image forming apparatus is described according to the steps each denoted with "S" in the flow diagram illustrating the flow of the print process in the embodiment of FIG. 6 with reference to FIGS. 1, 3, 4 and 5.

S1: The controller 501 of the print controller 500 of the image forming apparatus 100 starts roll/roll printing in which, based on the print data received by the interface part 521 from an external device, an image is formed on the roll-shaped print medium 80 held by the medium holder 81, and the print medium 80 on which the image is formed is wound by the winding holder 85.

When the roll/roll printing is started, the controller 501 controls the drum rotation number calculation part 503 to calculate the drum count Rn, the consumption dot count calculation part 504 to calculate the consumption dot count Dn, the belt rotation number calculation part 505 to calculate the belt count Bn and the transfer count Tn, the fuser rotation number calculation part 506 to calculate the fuser count Fn.

S2: The controller 501 determines whether or not an "A-type expendable item" has reached its end of life. When it is determined that the "A-type expendable item" has reached its end of life, the process proceeds to S6. When it is determined that the "A-type expendable item" has not reached its end of life, the process proceeds to S3. In this embodiment, the controller executes the determination a single sheet by a single sheet in order to avoid using a worn unit until the print job completes.

It is noted that the controller 501 monitors these expendable items whenever these items operate, for example an initial operation before printing. Such a monitoring is not limited during an actual printing. As noted above, the monitoring may be conducted after a rotation operation stops (or not in printing) as well as sheet by sheet. In a practical use, a life time margin is set for these items. Accordingly, even if one of these items reaches its life end, some more sheets are to be printed under such a life time margin. For example, after reaching the life time, ten plus some sheets are printed with a print quality guarantee. Nearly fifty sheets or some more are guaranteed to be printed without malfunction of the item.

Specifically, when the controller 501 determines that the transfer count Tn is equal to or greater than the threshold Tlimit or the fuser count Fn is equal to or greater than the threshold Flimit, the controller 501 determines that the "A-type expendable item" has reached its end of life, and, in order to cut the print medium 80 at the final page and to stop the carrying, the process proceeds to S6.

On the other hand, when the controller 501 determines that the transfer count Tn is less than the threshold Tlimit and the fuser count Fn is less than the threshold Flimit, the controller 501 determines that none of the "A-type expendable items" has reached its end of life, and, in order to continue the process, the process proceeds to S3.

S3: Having determined that the "A-type expendable items" have not reached their end of life, the controller 501 determines whether or not a "B-type expendable item" has reached its end of life. When the "B-type expendable item" has reached its end of life, the process proceeds to S4. When the "B-type expendable item" has not reached its end of life, the process proceeds to S7.

Specifically, when the drum count Rn is equal to or greater than the threshold Rlimit, the consumption dot count Dn is equal to or greater than the threshold Dlimit, or the belt count Bn is equal to or greater than the threshold Blimit, the controller 501 determines that a "B-type expendable item" has reached its end of life, and, in order to allow the user to select whether or not to stop the carrying by cutting the print medium 80 at the final page, the process proceeds to S4.

On the other hand, when it is determined that the drum count Rn is less than the threshold Rlimit, and the consumption dot count Dn is less than the threshold Dlimit, and the belt count Bn is less than the threshold Blimit, the controller 501 determines that none of the "B-type expendable items" has reached its end of life, and the process proceeds to S7 to continue the process.

S4: Having determined that a "B-type expendable item" has reached its end of life, the controller 501 reads, from the memory 507, information set in advance regarding whether or not to stop printing by cutting the print medium 80 at the final page or to stop printing without cutting the print medium 80. When it is determined that the information is set to stop printing by cutting the print medium 80, in order to stop printing by cutting the print medium 80, the process proceeds to S6. When it is determined that the information is set to stop printing without cutting the print medium 80, in order to stop printing without cutting the print medium 80, the process proceeds to S5. The information regarding whether or not to stop printing by cutting the print medium 80 or to stop printing without cutting the print medium 80 is entered and set by a user. An input operation regarding whether or not to stop printing by cutting the print medium 80 or to stop printing without cutting the print medium 80 is received by the operation part 523 in advance, and the information is stored in the memory 507. Such an above ce is termed as "Operator's Choice" in the drawing.choi Here, the selection input operation by the user regarding whether or not to stop printing by cutting the print medium 80 is performed by detecting an operation of pressing down a button provided in the operation part 523. The user performs settings for the case where a "B-type expendable item" reaches its end of life during a print operation by pressing a button that instructs "to stop printing by cutting" for the case of stopping printing by cutting the print medium 80, and pressing a button that instructs "stop printing without cutting" for the case of stopping printing without cutting the print medium 80.

It is noted that these counts above are conducted one line by one line at each of the developing timing by light sources 3 (YMCKT). With respect to drums and rollers that are rotational bodies, accumulation of the count is made by each of pulse signals generated at a predetermined rotation angle (e.g. 360 degrees). Rotation cycles and each of threshold values in FIG. 6 referring to the accumulation counts are set to generate early alarms to replace in order to secure a margin to guarantee print qualities, and are compared with the accumulation counts. It does not have to conduct the accumulation and the determination of life end at the same time in order to secure high accuracy and process distributions.

Regarding Step 7, under a normal condition, when completing to process all print data that are received for printing, it proceeds to Yes and end the print process. When the controller receives additional print data, a new process resumes from step 1. The controller starts printing such that a new print is made on the medium that is suspended.

Further, a detection of a print medium absence is described here. When the controller detects an absence of print medium 80, which is being carried, by medium sensor 87 (or where all print media 80 sitting at medium holder 81 side have been carried out), or detects an end mark, which was previously formed in the vicinity of print medium end edge, the controller terminates the print process. (It might proceed to S4, which corresponds to B-type when terminating the print process, continue to carry the print medium until the print section is ejected by selecting to cut or not to cut).

S5: The controller 501 sets a page at the time when it is determined that a "B-type expendable item" has reached its end of life as the final page, and controls the exposure controller 511 to interrupt exposure to the photosensitive drum 1 by the light source 3. The controller 501 continues to carry the print medium 80 without controlling the cutter unit 86 to cut the print medium 80.

The controller 501 controls the drive controller 510 and the high voltage controller 512 to transfer the toner image, which is obtained by developing the electrostatic latent image of the final page on the photosensitive drum 1, onto the belt 72 of the intermediate transfer unit 7, and further transfers the toner image to the print medium 80 at the secondary transfer roller 79 and fuse the toner image at the fuser 9.

The controller 501 controls the drive controller 510 to continue to carry the print medium 80 until the final page of the print medium 80 on which the toner image is fused passes through the carrying roller 82*e*, and when the final page passes through the carrying roller 82*e*, stops the carrying rollers 82*a*-82*e*, and stops the carrying of the print medium 80. Further, the controller 501 controls the separation controller 513 to move the separating bar 88 downward to separate the print medium 80 from the intermediate transfer unit 7, and stops the print operation, and terminates the present process.

The final page of the print medium is determined being passed through the carrying roller 82*e* as follow. The controller determines that the end of print medium passed carrying rollers 82 by driving rollers to carry the print medium for an enough distance to eject the end of print medium 87. The distance is calculated based on a distance of the carrying path from the carrying roller 82, which is positioned at further upstream side from the sensor 87 of the print medium, the sensor being at upstream side from the cutter unit 86, up to the carrying roller 82*e*.

S6: The controller 501 sets a page at the time when it is determined that an "A-type expendable item" or a "B-type expendable item" has reached its end of life as the final page, and controls the exposure controller 511 to interrupt exposure to the photosensitive drum 1 by the light source 3. The controller 501 controls the cutter unit 86 to cut the print medium 80 by ensuring a length of the final page.

The controller 501 controls the drive controller 510 and the high voltage controller 512 to transfer the toner image, which is obtained by developing the electrostatic latent image of the final page on the photosensitive drum 1, onto the belt 72 of the intermediate transfer unit 7, and further transfers the toner image to the print medium 80 at the secondary transfer roller 79 and fuse the toner image at the fuser 9.

The controller 501 controls the drive controller 510 to continue to carry the print medium 80 until a trailing edge of the final page of the cut print medium 80 on which the toner image is fused passes through the carrying roller 82*e*, and when the trailing edge of the cut final page passes through the carrying roller 82*e*, stops the carrying rollers 82*a*-82*e*, and stops the carrying of the print medium 80.

Having stopped the carrying of the print medium 80, the controller 501 stops the print operation, and terminates the present process.

Next, in the case where the printing is stopped during a continuous printing operation and in the case where printing is continued, a length of a waste print medium that is not used in printing is described with reference to an explanatory diagram of a print medium in the embodiment of FIG. 7 and an explanatory diagram of a waste sheet in the embodiment of FIG. 8. The image forming apparatus 100 is described using an example in which a printer corresponding to a print medium 80 having a label having a width of 4 inch is used.

Figure 7:
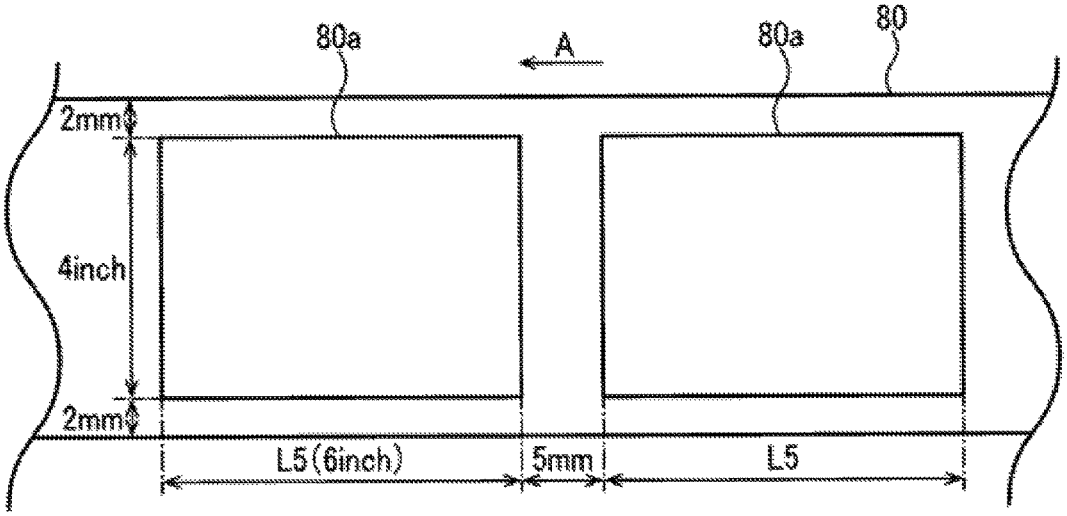
FIG. 7 is an explanatory diagram of a print medium in the embodiment.

As illustrated in FIG. 7, in the roll-shaped print medium 80 to be used, label parts 80*a* are provided on a mount. A lateral width (length in a transverse direction orthogonal to the medium carrying direction indicated by an arrow A in the drawing) is 4 inch +4 mm. A margin of 2 mm is provided between an edge of each of the label parts 80*a* and an edge of the mount on both lateral sides. Further, a lateral length of each of the label parts 80*a* is 4 inch, a length L5 in a longitudinal direction (the medium carrying direction indicated by the arrow A in the drawing) is 6 inch, and a distance between the label parts 80*a* is 5 mm. Further, the print medium 80 is a label medium of 81.4 g/m2 high quality paper (for example, 70 PW manufactured by Lintec Corporation).

Further, a print speed is 6 ips (inch per second) and 152.4 mm/s.

Before starting a print operation, a leading edge of the roll-shaped print medium 80 held by the medium holder 81 of the image forming apparatus 100 is sandwiched between the carrying roller 82*a* and the pinch roller 83*a*. The image forming apparatus 100 starts an initial (initialization) operation based on a received signal. In the initial operation, an idle rotation operation of each roller of the development units 11, the intermediate transfer unit 7, and the fuser 9 is performed. In the present embodiment, an idle rotation operation time is set to 20 seconds, which corresponds to a print medium carrying distance of L1=3048 mm.

During the initial operation, when the leading edge of the print medium 80 is in a state of being sandwiched between the carrying roller 82*a* and the pinch roller 83*a*, there is no need to carry the print medium 80.

However, in a state in which the print medium 80 passes through the inside of the image forming apparatus 100 (a state in which the leading edge of the print medium 80 is being wound by the winding holder 85), during the initial operation, the idle rotation operation is performed at the intermediate transfer unit 7 and the fuser 9, which are in contact with the print medium 80. Therefore, the image forming apparatus 100 carries the print medium 80 in accordance with the idle rotation operation.

When the initial operation ends, the image forming apparatus 100 starts the print operation based on the received print data. The image forming apparatus 100 forms a toner image with the development units 11 and transfers the toner image to the print medium 80 via the intermediate transfer unit 7. In this case, the carrying roller 82*a* and exposure start timing of the development unit 11 are adjusted such that the leading edge of the print medium 80 and a leading edge of a page that transfers the toner image are aligned.

Figure 8:
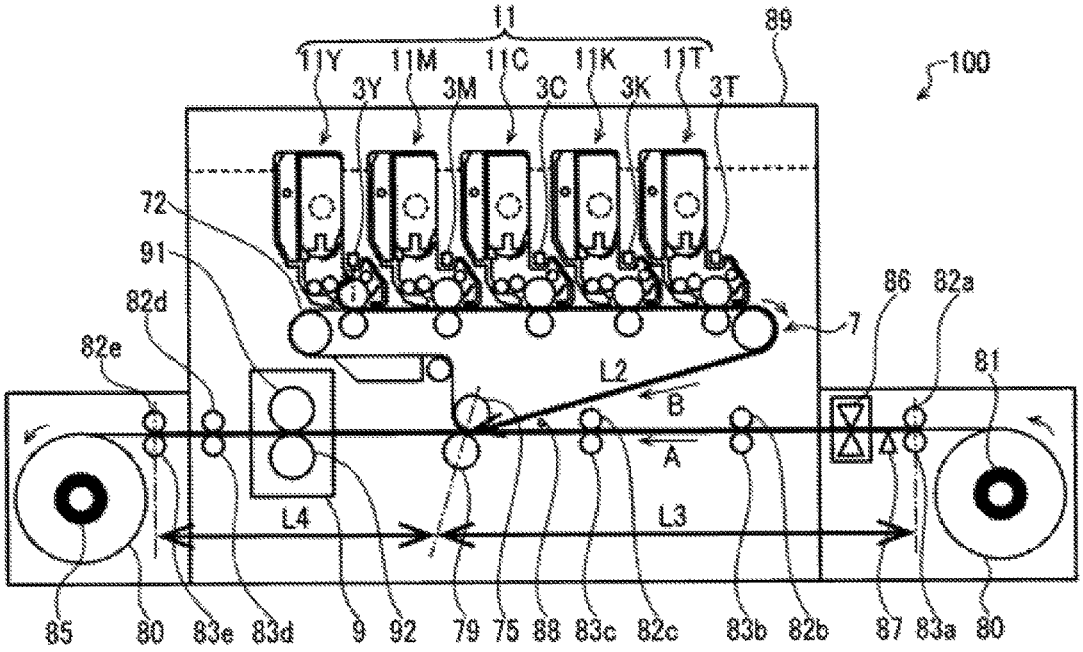
FIG. 8 is an explanatory diagram of waste paper in the embodiment.

As illustrated in FIG. 8, a distance for the toner image to reach the secondary transfer roller 79 from an exposure position of the light source 3Y of the development unit 11Y arranged most upstream in the rotation direction of the belt 72 of the intermediate transfer unit 7 is L2=680 mm, and a distance for the print medium 80 to reach the secondar22y transfer roller 79 from the carrying roller 82*a* is L3=340 mm.

Actually, distance L3 is defined between two nip portions, which are spots where two rollers are in contact in a pressed fashion. The one nip portion is formed by rollers 82*a* and 83*a*. The other nip portion is formed by rollers 75 and 79. Distance L4 is also defined between other two nip portions. The one nip portion is formed by rollers 75 and 79. The other nip portion is formed by rollers 82*e* and 83*e*. The arrow lengths L3 and L4 and their proportion (L3/L4) in FIG. 8 do not correctly represent these distances and the relationship.

Since the distance L3 is shorter than the distance L2, it is necessary to set the exposure timing by the development unit 11Y earlier than the timing of starting the carrying of the print medium 80 by the carrying roller 82*a*. Therefore, after the exposure by the development unit 11Y is started, the image forming apparatus 100 starts driving of the carrying roller 82*a* after a delay of 2.23 seconds ((680 mm−340 mm)/(152.4 mm/s)).

However, in the case of the state in which the leading edge of the print medium 80 is wound by the winding holder 85 at the start of a print operation, since the carrying medium 80 has already been carried by the carrying rollers 82*a*-82*e* in the initial operation, it is not possible to delay the carrying start timing relative to the exposure timing. Therefore, the print medium 80 is carried by the distance L2 (=680 mm), which is the distance for the toner image to reach the secondary transfer roller 79 from the exposure position by the light source 3Y.

As illustrated in FIG. 8, the print medium 80 of which the leading edge is sandwiched by the carrying roller 82*a* is carried by a distance L3=340 mm, which is the distance for the print medium 80 to reach the secondary transfer roller 79 from the carrying roller 82*a*. Thereafter, the print medium 80 to which the toner image has been transferred by the secondary transfer roller 79 passes through the fuser 9, and is carried by a distance a distance that is a sum of the distance L4=164 mm from the secondary transfer roller 79 to the carrying roller 82*e* and a length L5=152.4 mm (6 inch) of the label part 80*a* of the print medium 80, and is carried until a trailing edge of the label part passes through the carrying roller 82*e*.

Therefore, in the case of the state in which the leading edge of the print medium 80 is sandwiched by the running roller 82*a*, a distance L by which the print medium 80 is carried from the start of printing until printing of one page is completed is the distance L=L3+L4+L5=656.4 mm.

Further, once printing is finished, the print medium 80 is in a state of having passed through the image forming apparatus 100, and the leading edge of the print medium 80 is wound by the winding holder 85. Therefore, the distance L by which the print medium 80 is carried from the start of the printing until the printing of one page is completed is the distance L=L1+L2+L4+L5=3704.4 mm.

Further, in the case where, during a print operation of the roll/roll printing, it is determined that the development unit 11 has reached its end of life and the printing is stopped and the print medium 80 is not cut, the print medium 80 carried during a period from when the final page passes through the secondary transfer roller 79 to when the final page passes through the carrying roller 82*e* is not used in printing, and thus becomes a waste sheet which is a waste print medium. A length of the print medium 80 in the medium carrying direction that becomes the waste sheet is a distance L between the carrying roller 82*a* and the carrying roller 82*e*, and the distance L=L3+L4=504 mm.

In the case where, during a print operation of the roll/roll printing, it is determined that the development unit 11 has reached its end of life and the printing is stopped and the print medium 80 is cut, a length of the print medium 80 in the medium carrying direction that becomes a waste sheet is 0 mm.

Here, during a continuous print operation of the roll/roll printing, when an "A-type expendable item" or a "B-type expendable item" reaches its end of life and the printing is stopped, the distances (lengths) in the medium carrying direction of the waste sheets occurring in the case where the print medium 80 is cut and in the case where the print medium 80 is not cut are compared.

First, a comparative example of the case where the print medium 80 is not cut when an "A-type expendable item" reaches its end of life and the printing is topped is described.

In this comparative example, it is necessary to remove the print medium 80 that has passed through the image forming apparatus 100. Therefore, a distance between the carrying roller 82*a* and the carrying roller 82*e* becomes a wasted sheet. Therefore, the distance L that becomes a waste sheet corresponds to L=L3+L4=504 mm.

Further, when the print medium 80 has to be cut during printing and is wound by the winding holder 85, the roll of the print medium 80 is divided.

Next, in the present embodiment, the case where the print medium 80 is not cut when a "B-type expendable item" reaches its end of life and the printing is topped is described. In this case, when a "B-type expendable item" is replaced, it is not necessary to remove the print medium 80 that has passed through the image forming apparatus 100, and it is not necessary to cut the print medium 80. Therefore, when the print medium 80 is wound by the winding holder 85, the roll of the print medium 80 is not divided.

However, since the image forming apparatus 100 resumes printing without removing the print medium 80 after stopping printing, the leading edge of the print medium 80 is wound by the winding holder 85. Therefore, the print medium 80 carried between the initial operation and when the toner image formed in the development unit 11 is transferred becomes a waste sheet. Therefore, the distance L that becomes a waste sheet is L=(L4+L5)+(L1+L2)=4232 mm.

Further, in the present embodiment, the case where the print medium 80 is cut when an "A-type expendable item" or a "B-type expendable item" reaches its end of life and the printing is topped is described.

In the embodiment, the print medium is cut during the print process (or while transferring by transfer roller 79). In a case where the cut is done after printing, the cut process is done after the final image passes the fuser 9. Further, in order not to leave the remaining portion inside, the medium is carried for distance (L3+L4).

In this case, when an "A-type expendable item" or a "B-type expendable item" is replaced, the print medium 80 that has passed through the image forming apparatus 100 is cut. Therefore, a waste sheet of the print medium 80 does not occur, and the distance L that becomes a waste sheet is L=0 mm. However, in order to cut the print medium 80, when the print medium 80 is wound by the winding holder 85, the roll of the print medium 80 is divided.

In the present embodiment, in the case where an "A-type expendable item" reaches its end of life, the controller 501 of the image forming apparatus 100 allows the "A-type expendable item" to be replaced in a state in which the print medium 80 does not remain in the image forming apparatus 100 when the printing is stopped by cutting the print medium 80 at a trailing edge of the final page, and allows occurrence of a waste sheet, which is a portion of the print medium 80 that is not used in printing, to be suppressed.

For example, the sensor 87 is an optical sensor. When the sensor 87 senses an end of the label part 80*a*, the controller moves the medium for a distance from the sensor 87 to the cutter, then cuts it. The sensor is able to sense the label part 80*a*, the mount, and print medium absence with that manner With these structures, a label part 80*a*, which corresponds to the final image to be printed by 11Y from distances of L2 and L3, is determined, and a cut process is performed based on the detection of the end of the label part 80*a* by the sensor 87. Otherwise, the cut process is not performed but the medium is carried for distance (L3+L4) that is a distance from roller 82*a* to roller 82*e*.

Further, during an operation of the roll/roll printing, when a "B-type expendable item" reaches its end of life, the controller 501 of the image forming apparatus 100 allows the user to select to set whether or not to reduce an amount of waste sheets by cutting the print medium 80 at the trailing edge of the final page or whether or not to prevent a roll of the print medium 80 from being divided when the print medium 80 is not cut at the trailing edge of the final page and is wound by the winding holder 85, and thus allows user convenience to be improved when an expendable item reaches its end of life.

In this way, when an "A-type expendable item" or a "B-type expendable item" reaches its end of life and printing is stopped, by cutting the print medium 80, occurrence of a waste sheet can be suppressed.

Further, when a "B-type expendable item" reaches its end of life, by allowing the user to select whether to stop printing by cutting the print medium 80 or to stop printing without cutting the print medium 80, the user can select whether or not to reduce the amount of waste sheets or to prevent a roll of the print medium 80 from being divided.

As described above, in the present embodiment, by allowing the user to select whether or not to stop printing by cutting the print medium or to stop printing without cutting the print medium, the user can select whether or not to reduce the amount of waste sheets or to prevent a roll of the print medium from being divided, and user convenience can be improved when an expendable item reaches its end of life.

In the present embodiment, the image forming apparatus is described as a printer. However, the present invention is not limited to this. The image forming apparatus may also be a copying machine, a facsimile machine, a multifunction machine (MFP), and the like. The present invention is not limited to the above-described embodiments. Based on the spirit of the present invention, various modifications are possible, which are not to be excluded from the scope of the present invention.

1: photosensitive drum
2: charging roller
3, 3Y, 3M, 3C, 3K, 3T: light source
4: development roller
5: supply roller
6: development blade
7: intermediate transfer unit
8: cleaning device
9: fuser
11, 11Y, 11M, 11C, 11K, 11T: development unit
20, 40, 50, 70, 78: power source
71: primary transfer roller
72: belt
79: secondary transfer roller
81: medium holder
82*a*-82*e*: carrying rollers
83*a*-83*e*: pinch rollers
85: winding holder
86: cutter unit
87: medium detection sensor
88: separating bar
100 image forming apparatus
111: toner container
112: waste toner container
500: print controller
501: controller
503: drum rotation number calculation part
504: consumption dot count calculation part
505: belt rotation number calculation part
506: fuser rotation number calculation part
507: memory
510: drive controller
511: exposure controller
512: high voltage controller
513: separation controller
521: interface part
522: display part
523: operation part
531: drum drive part
532: belt drive part
533: carrying drive part
534: fuser drive part
535: cutter drive part
536: separation drive part

What is claimed is:

1. An image forming apparatus comprising:
a medium carrying part that carries a continuous medium;
an image forming part that performs a print process forming a developer image on the medium;
a cutting part that cuts the medium;
a plurality of replacement parts that are expendable and expected to be replaced when reaching its end of life;
a usage detection part that detects usages of all of the replacement parts, providing a detection result;
a controller that controls the medium carrying part, the image forming part, the cutting part and the usage detection part, wherein
the controller determines if one of the replacement parts reaches its end of life during the print process based on the detection result of the usage detection part wherein the one of the replacement parts is defined as a life-end part, and
when the life-end part is found, the controller determines whether or not to cut the medium according to a type of the life-end part and selection information input by an operator before the print process starts.

2. The image forming apparatus according to claim 1, wherein
the replacement parts are classified into two types,
one of the types is defined as first replacement parts for which it is not necessary to remove the medium at the time of replacing the life-end part,
the other of the types is defined as second replacement parts for which it is necessary to remove the medium at the time of replacing the life-end part, and
the controller cuts the medium when one of the first replacement parts reaches its end of life, and only when the selection information indicates to cut the medium,
the controller cuts the medium whenever one of the second replacement parts reaches its end of life.

3. The image forming apparatus according to claim 2, wherein
when one of the first replacement parts reaches its end of life, the controller determines not to cut the medium when the selection information does not indicate to cut the medium.

4. The image forming apparatus according to claim 2, further comprising:
a lid part that is able to open and close with respect to a main body of the apparatus, wherein the first replacement parts are arranged between a medium carrying path, along which the medium is carried, and the lid part.

5. The image forming apparatus according to claim 2, further comprising:

an operation part that is used to receive the selection information by the operator wherein the selection information includes an indication that the operator intends either to cut the medium or not when one of the first replacement parts reaches its end of life.

6. The image forming apparatus according to claim 2, further comprising:

a transfer part that transfers the developer image formed by the image forming part to the medium; and a fuser part that fuses the developer image transferred to the medium, wherein the first replacement parts include the image forming part, and the second replacement parts include the transfer part and the fuser part.

7. The image forming apparatus according to claim 2, further comprising:

a transfer part that transfers the developer image formed by the image forming part to the medium; and a fuser part that fuses the developer image transferred to the medium, wherein the first replacement parts include the image forming part and the transfer part, and the second replacement parts include the fuser part.

8. The image forming apparatus according to claim 2, wherein the print process is executed based on a print job, the controller analyses the print job, determining a length of a single page in the print process, the controller executes to determine if the one of the replacement parts reaches its end of life every time when the print process completes for the length of the single page.

9. An image forming apparatus comprising:

a medium carrying part that carries a continuous medium;

an image forming part that performs a print process forming a developer image on the medium;

a cutting part that cuts the medium;

a cover that is able to be open and closed;

a plurality of replacement parts that are expendable and to be replaced while the cover is open;

a condition detection part that detects conditions of all of the replacement parts, providing a detection result;

a controller that controls the medium carrying part, the image forming part, the cutting part and the condition detection part, wherein when the controller stops printing to replace one of the replacement parts, which is regarded as a replacement target, during the print process, the controller cuts the medium in a case where the medium is positioned closer to the cover than the one of the replacement parts that is the replacement target.

10. The image forming apparatus according to claim 9, further comprising:

a selection part that is input from an operator, wherein when the controller stops printing to replace one or more of the replacement parts, which are the replacement targets, during the print process based on the detection result from the condition detection part, the selection part selects whether or not to cut the medium in a case where the one or more of the replacement parts are all positioned closer to the cover than the medium.

* * * * *